US005875563A

United States Patent [19]

Snow

[11] Patent Number: 5,875,563

[45] Date of Patent: Mar. 2, 1999

[54] BABY BOTTLE ORGANIZER FOR DRYING

[76] Inventor: Martin G. Snow, 24 Bishopgate Dr., Rochester, N.Y. 14624

[21] Appl. No.: 891,401

[22] Filed: Jul. 10, 1997

[51] Int. Cl.[6] ..... F26B 25/00

[52] U.S. Cl. ..... 34/103; 34/106; 34/107

[58] Field of Search ..... 34/103, 104, 106, 34/107; 206/139; 220/514, DIG. 2; D3/304, 313

[56] References Cited

U.S. PATENT DOCUMENTS

| | | | |
|---|---|---|---|
| D. 318,552 | 7/1991 | Apps | D34/40 |
| D. 356,211 | 3/1995 | Apps et al. | D3/304 |
| 1,460,068 | 6/1923 | Linfoot | 220/DIG. 2 X |
| 4,845,859 | 7/1989 | Evans | 34/107 |
| 4,928,841 | 5/1990 | Arthurs | 220/21 |
| 5,507,543 | 4/1996 | Shefflin | 294/146 |

*Primary Examiner*—Henry Bennett
*Assistant Examiner*—Steve Gravini

[57] ABSTRACT

An apparatus for drying and storing a plurality of baby bottles is provided including a housing with side faces defining an open bottom. Such housing has a top face integrally coupled to top edges of the side faces. The top face has a plurality of compartments coupled thereto which extend downwardly therefrom. Such compartments each define an open top that is flush with the top face of the housing. The compartments are adapted to allow the placement of a bottle therein. Each of the compartments have a plurality of slots formed therein for allowing the drying of the bottles.

4 Claims, 2 Drawing Sheets

BABY BOTTLE ORGANIZER FOR DRYING

BACKGROUND OF THE INVENTION

1. Field of the Invention

The present invention relates to drying racks and more particularly pertains to a new BABY BOTTLE ORGANIZER for allowing the convenient drying and storage of a plurality of bottles and associated components.

2. Description of the Prior Art

The use of drying racks is known in the prior art. More specifically, drying racks heretofore devised and utilized are known to consist basically of familiar, expected and obvious structural configurations, notwithstanding the myriad of designs encompassed by the crowded prior art which have been developed for the fulfillment of countless objectives and requirements.

Known prior art drying racks include U.S. Pat. No. 4,928,841; U.S. Pat. No. Des. 318,552; U.S. Pat. No. Des. 356,211; U.S. Pat. No. 5,419,451; U.S. Pat. No. 5,423,445; and U.S. Pat. No. 5,351,814.

In these respects, the BABY BOTTLE ORGANIZER according to the present invention substantially departs from the conventional concepts and designs of the prior art, and in so doing provides an apparatus primarily developed for the purpose of allowing the convenient drying and storage of a plurality of bottles and associated components.

SUMMARY OF THE INVENTION

In view of the foregoing disadvantages inherent in the known types of drying racks now present in the prior art, the present invention provides a new BABY BOTTLE ORGANIZER construction wherein the same can be utilized for allowing the convenient drying and storage of a plurality of bottles and associated components.

The general purpose of the present invention, which will be described subsequently in greater detail, is to provide a new BABY BOTTLE ORGANIZER apparatus and method which has many of the advantages of the drying racks mentioned heretofore and many novel features that result in a new BABY BOTTLE ORGANIZER which is not anticipated, rendered obvious, suggested, or even implied by any of the prior art drying racks, either alone or in any combination thereof.

To attain this, the present invention generally comprises a housing. The housing includes four side faces each extending outwardly from a top edge to a bottom edge thereof. The side faces include a pair of short side faces integrally coupled in perpendicular relationship between a pair of long side faces thereby defining an open bottom. The housing further has a top face integrally coupled to the top edges of the side faces. The top face has a plurality of compartments coupled thereto and extended downwardly therefrom. Each of such compartments define an open top that is flush with the top face. Note FIGS. 3 & 4. The compartments include a plurality of bottle compartments. As shown in FIG. 4, each of such bottle compartments are defined by a vertical upper periphery having a hexagonal cross-section and a top edge integrally coupled to the top face. A lower periphery is beveled inwardly in a radial direction from a lower edge of the upper periphery downwardly. A bottom circular face is horizontally disposed at a lower edge of the lower periphery and has a plurality of apertures formed therein. By this structure, a bottle may be disposed face down therein for drying. The compartments further include a nipple compartment with a beveled periphery having a top edge integrally coupled to the top face of the housing and depending downwardly and inwardly. The nipple compartment further has a bottom rectangular face integrally coupled to a bottom edge of the beveled periphery with a plurality of slots formed therein. As such, a plurality of nipples may be disposed within the present compartment for drying.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new BABY BOTTLE ORGANIZER apparatus and method which has many of the advantages of the drying racks mentioned heretofore and many novel features that result in a new BABY BOTTLE ORGANIZER which is not anticipated, rendered obvious, suggested, or even implied by any of the prior art drying racks, either alone or in any combination thereof.

It is another object of the present invention to provide a new BABY BOTTLE ORGANIZER which may be easily and efficiently manufactured and marketed.

It is a further object of the present invention to provide a new BABY BOTTLE ORGANIZER which is of a durable and reliable construction.

An even further object of the present invention is to provide a new BABY BOTTLE ORGANIZER which is susceptible of a low cost of manufacture with regard to both materials and labor, and which accordingly is then susceptible of low prices of sale to the consuming public, thereby making such BABY BOTTLE ORGANIZER economically available to the buying public.

Still yet another object of the present invention is to provide a new BABY BOTTLE ORGANIZER which provides in the apparatuses and methods of the prior art some of the advantages thereof, while simultaneously overcoming some of the disadvantages normally associated therewith.

Still another object of the present invention is to provide a new BABY BOTTLE ORGANIZER for allowing the convenient drying and storage of a plurality of bottles and associated components.

Even still another object of the present invention is to provide a new BABY BOTTLE ORGANIZER that includes a housing with side faces defining an open bottom. Such housing has a top face integrally coupled to top edges of the side faces. The top face has a plurality of compartments coupled thereto which extend downwardly therefrom. Such compartments each define an open top that is flush with the top face of the housing. The compartments are adapted to allow the placement of a bottle therein. Each of the compartments have a plurality of slots formed therein for allowing the drying of the bottles.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
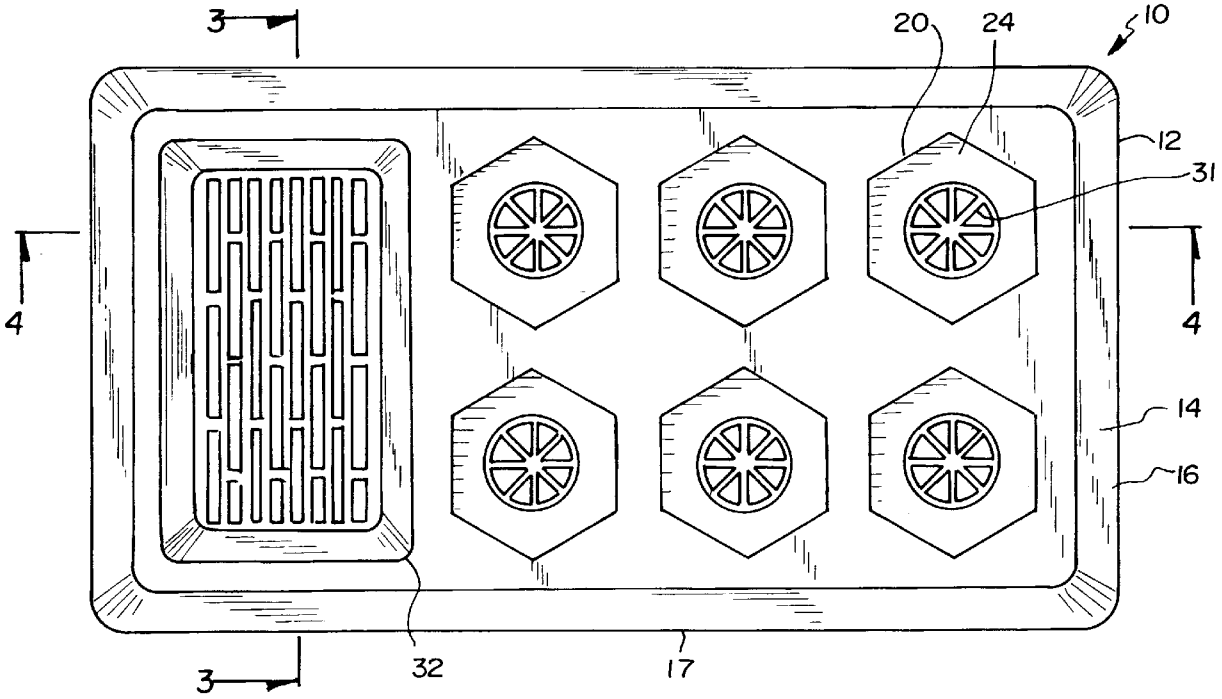
FIG. 1 is a top view of a new BABY BOTTLE ORGANIZER according to the present invention.
Figure 2:
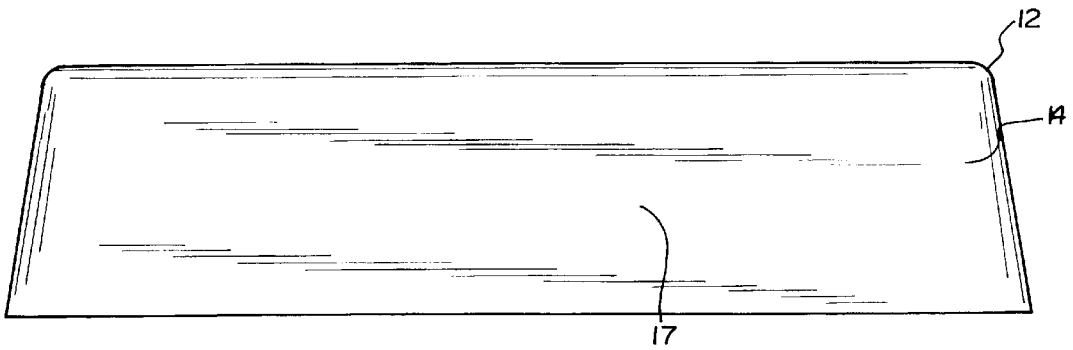
FIG. 2 is a side view of the present invention.

With reference now to the drawings, a new BABY BOTTLE ORGANIZER embodying the principles and concepts of the present invention and generally designated by the reference numeral 10 will be described.

As shown in the Figures, the system 10 of the present invention includes a thermoplastic housing 12. The housing includes four side faces 14 each extending outwardly from a top edge to a bottom edge thereof. The side faces include a pair of short side faces 16 integrally coupled in perpendicular relationship between a pair of long side faces 17 thereby defining an open bottom 18. The housing further has a top face integrally coupled to the top edges of the side faces. In the preferred embodiment, the housing has a length of about 12 inches, a width of about 6 inches, and a height of about 3 inches. As such, the length is about twice the width and about four times the height.

Figure 3:
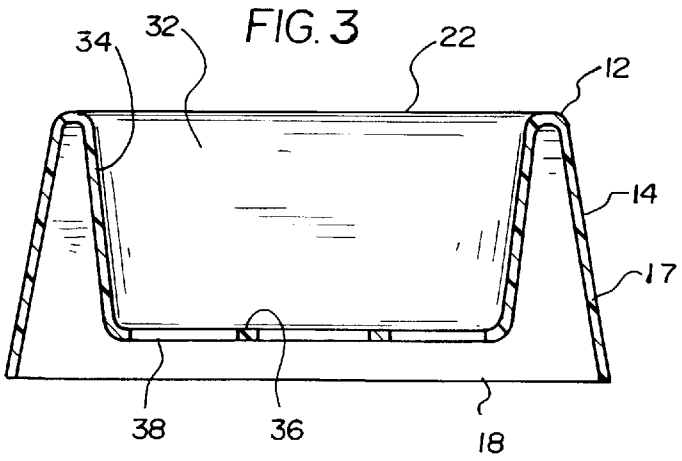
FIG. 3 is a cross-sectional view of the present invention taken along line 3—3 shown in FIG. 1.

The top face has a plurality of compartments 20 coupled thereto and extended downwardly therefrom. Each of such compartments define an open top 22 that is flush with the top face. Note FIGS. 3 & 4. Further, the compartments have a depth slightly less than the height of the housing.

Figure 4:
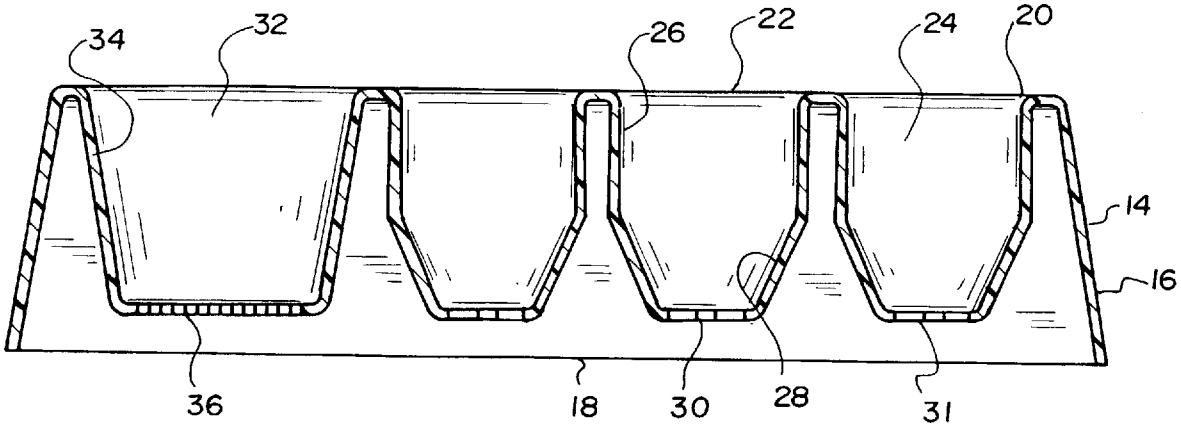
FIG. 4 is a cross-sectional view of the present invention taken along line 4—4 shown in FIG. 1.

The compartments include a plurality of bottle compartments 24. As shown in FIG. 4, each of such bottle compartments is defined by a vertical upper periphery 26 having a hexagonal cross-section and a top edge integrally coupled to the top face. A lower periphery 28 is beveled inwardly in a radial direction from a lower edge of the upper periphery downwardly. Preferably, a height of the lower periphery is the same as that of the upper periphery. A bottom circular face 30 is horizontally disposed at a lower edge of the lower periphery and has a plurality of apertures 31 formed therein. Such apertures are ideally pie-shaped. By this structure, a bottle may be disposed face down therein for drying. As shown in FIG. 1, there are six bottle compartments configured in two linearly aligned rows adjacent a first short side face of the housing.

The compartments further include a nipple compartment 32 positioned adjacent a second one of the short side faces of the housing. The nipple compartment constitutes about ⅓ of the area of the top face of the housing. The nipple compartment is equipped with a beveled periphery 34 having a top edge integrally coupled to the top face of the housing and depending downwardly and inwardly. The nipple compartment further has a bottom rectangular face 36 integrally coupled to a bottom edge of the beveled periphery with a plurality of slots 38 formed therein. Preferably, the slots are rectangular and constitute at least 50% the area of the bottom face. As such, a plurality of nipples, rings, and caps may be disposed within the present compartment for drying. After the bottle and associated accessories have dried, the present invention is adapted to be conveniently stored in a cabinet or the like.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An apparatus for drying and storing a plurality of baby bottles comprising, in combination:

a housing including side faces each extending outwardly from a top edge to a bottom edge thereof, the side faces including a pair of short side faces integrally coupled in perpendicular relationship between a pair of long side faces thereby defining an open bottom, the housing further has a top face integrally coupled to the top edges of the side faces, the top face having a plurality of compartments coupled thereto and extending downwardly therefrom thereby defining an open top that is flush therewith, the compartments including a plurality of bottle compartments each defined by a vertical upper periphery having a hexagonal cross-section and a top edge integrally coupled to the top face, a lower periphery beveled linearly inwardly in a radial direction from a lower edge of the upper periphery downwardly, and a bottom circular face having a plurality of apertures formed therein whereby a bottle may be disposed face down therein for drying, the compartments further including a nipple compartment including a beveled periphery having a top edge integrally coupled to the top face of the housing and depending downwardly and inwardly and a bottom rectangular face integrally coupled to a bottom edge of the beveled periphery with a plurality of slots formed therein, whereby a plurality of nipples may be disposed therein for drying.

2. An apparatus for drying and storing a plurality of baby bottles comprising a housing including side faces defining an open bottom and a top face integrally coupled to top edges of the side faces, the top face having a plurality of compartments coupled thereto and extending downwardly therefrom thereby defining an open top that is flush therewith, the compartments adapted to allow the placement of a bottle therein and each having a plurality of slots formed therein for allowing the drying of the bottles, wherein the compartments further include a nipple compartment having a beveled periphery with a top edge integrally coupled to the top face of the housing and depending downwardly and inwardly and a bottom rectangular face integrally coupled to a bottom edge of the beveled periphery with a plurality of slots formed therein, whereby a plurality of nipples may be disposed therein for drying.

3. An apparatus for drying and storing a plurality of baby bottles as set forth in claim 2 wherein the compartments includes a plurality of bottle compartments each defined by a vertical upper periphery integrally coupled to the top face, a lower periphery beveled inwardly in a radial direction from a lower edge of the upper periphery downwardly, and a bottom face having a plurality of apertures formed therein whereby a bottle may be disposed face down therein for drying.

4. An apparatus for drying and storing a plurality of baby bottles as set forth in claim 3 wherein the vertical upper periphery has a hexagonal cross-section.

* * * * *